United States Patent [19]

Murphy

[11] 4,192,119

[45] Mar. 11, 1980

[54] STRUCTURAL MEMBER

[75] Inventor: Wesley T. Murphy, Auburn, N.Y.

[73] Assignee: E.T.I. Corporation, Auburn, N.Y.

[21] Appl. No.: 947,825

[22] Filed: Oct. 2, 1978

[51] Int. Cl.[2] ..... E04C 1/30

[52] U.S. Cl. ..... 52/588; 52/731

[58] Field of Search ..... 52/588, 731, 732, 730, 52/762, 284, 285, 423

[56] References Cited

U.S. PATENT DOCUMENTS

| | | | |
|---|---|---|---|
| 1,307,187 | 6/1919 | Disbro | 52/588 |
| 1,925,417 | 9/1933 | Swank | 52/284 |
| 1,925,418 | 9/1933 | Swank | 52/285 |
| 2,039,293 | 5/1936 | Calkins et al. | 52/588 |
| 2,062,160 | 11/1936 | Calkins et al. | 52/588 |
| 2,272,910 | 2/1942 | Gobberdiel | 52/588 |

*Primary Examiner*—James L. Ridgill, Jr.
*Attorney, Agent, or Firm*—Bruns & Jenney

[57] ABSTRACT

A structural member having similar flanges mounted on either end. The flanges of individual members can be interlocked to form either right angle sections or rectangular columns.

3 Claims, 3 Drawing Figures

STRUCTURAL MEMBER

BACKGROUND OF THE INVENTION

This invention relates to a structural member and, in particular, to a structural member that is capable of being interlocked with a member of similar construction to form a right angle section or a rectangular column.

As is well known in the art, preformed structural shapes have been used for some time in the building industry to carry out a wide variety of tasks. For the most part, however, these preformed members are generally designed to perform one specific function, are usually complex in construction and are relatively difficult to assemble. Furthermore, once brought into assembly, the component parts of the unit usually do not provide sufficient temporary holding power to allow the assemblage to be quickly and safely erected.

SUMMARY OF THE INVENTION

It is therefore an object of the present invention to improve structural members used in the construction of buildings or the like.

A further object of the invention is to provide a structural member that is capable of being joined to similar members to provide right angle sections or rectangular columns.

Another object of the present invention is to simplify the form of interlocking structural members used to create building sections.

A still further object of the present invention is to provide a structural member having a rectangular flange that can be simply snapped into place with another similar structure to provide an assembly having sufficient temporary holding power to allow the assemblage to be rapidly and safely erected.

These and other objects of the present invention are attained by means of a structural member including an elongated web having open ended flanges projecting laterally to the same side of the web from each of its two longitudinal edges and being opened to the opposite side of the web. Each flange is rectangular in form and includes a bottom wall or base and two parallel side walls. The inner side wall connects the base to the web while the outer side wall contains a lip that lies in the plane of the web and which is turned inwardly toward the web to restrict the flange opening. The length of the lip is controlled to allow two flanges to be snapped together with sufficient holding power to securely hold the two cojoined members together and thus enable the assemblage to be easily handled and erected at the building site.

BRIEF DESCRIPTION OF THE DRAWINGS

For a better understanding of these and further objects of the present invention reference is had to the following detailed description of the invention which is to be read in conjunction with the following drawings, wherein.

DESCRIPTION OF THE INVENTION

Figure 1:
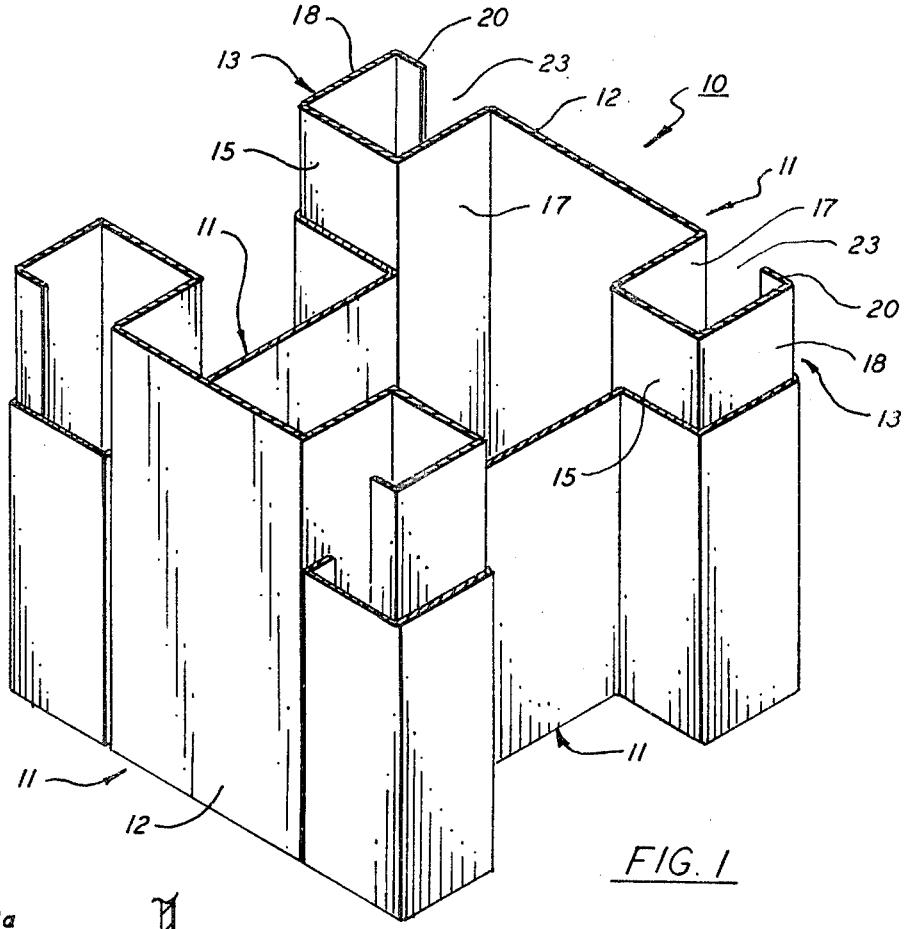
FIG. 1 is a perspective view showing four structural members embodying the teachings of the present invention brought together to form a building column.

As illustrated in FIG. 1, there is shown a building column referenced 10 that is formed by bringing together four structural members, generally designated 11, which embody the teachings of the present invention. Each of the structural members includes an elongated web 12 having two end flanges 13 projecting laterally to one side of the web. The flanges, which are of similar construction, are generally rectangular in form and are open to the opposite side of the web. Preferably the structural member is roll formed from a single sheet of material that possesses relatively high strength but which is resilient enough to permit the member to deform sufficiently so that it can be interlocked or snapped together with similar members in a manner which shall be explained in greater detail below.

Each rectangular flange includes a bottom wall or base 15 that is positioned in parallel alignment with the web. The base is connected to the longitudinal edge of the web by means of an inner side wall 17 that is normal to the plane of the web. A second outer side wall 18 depends upwardly from the outer edge of the base. The outer side wall is positioned in parallel alignment with the inner side wall and teminates in the plane of the web. A lip 20 depends inwardly from the distal end of the outer wall and is located in coplanar relationship with the web. In practice, the lip extends inwardly into the opening 23 of the flange to restrict the size of the opening.

Figure 2:
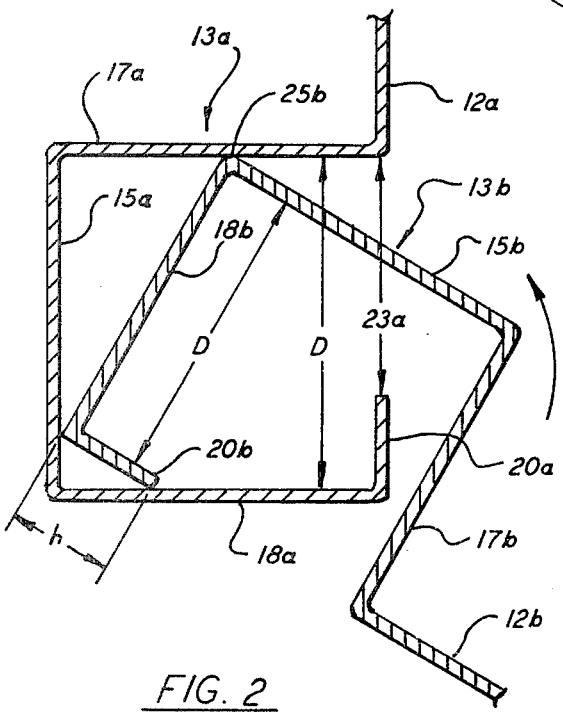
FIGS. 2 and 3 illustrate the steps involved in snapping the end flanges of two members shown in FIG. 1 together to form a right angle section.
Figure 3:
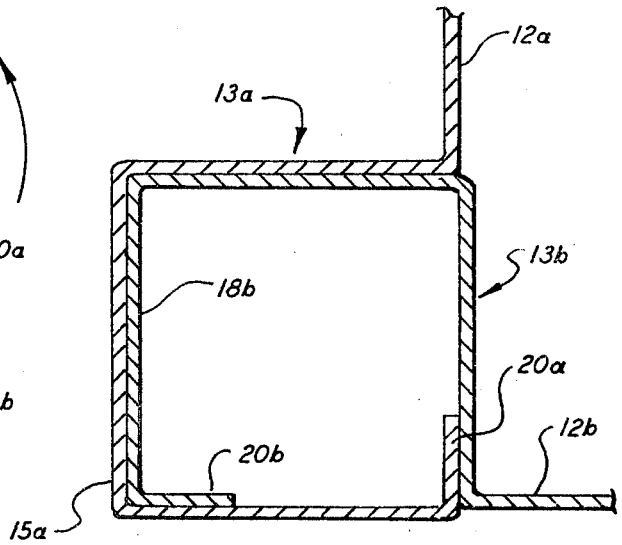

As best seen in reference to FIGS. 2 and 3, each flange is constructed so that the inside width of the flange between the two side walls 17 and 18 is held to a given dimension "D" that is substantially equal to or slightly greater than the overall depth of the flange as measured over the base 15 and the extended lip 20. As a result of this construction, a flange carried by one member can be conveniently received within the flange of a second member with the walls of the two cojoined flanges being in contiguous relationship as illustrated in FIG. 3.

To join the flange of one member with that of another, the lip of the first flange is inserted obliquely into the restricted opening of the second flange as shown in FIG. 2 and the members rotated as indicated by the arrow to seat one flange within the other. For purposes of explanation, the component parts of the receiving flange shown in FIGS. 2 and 3 shall be designated with the letter "a" while those of the accepted flange received therein shall be designated with the letter "b".

The overall length "h" of the turned lips **20*a* or 20*b* is held to about one third of the inside width "D" of the flange. By holding this width to lip length relationship to about that noted, the lip 20*b* will become seated between the base and the outer side wall of the receiving flange 13*a* as the flanges are turned. This in turn will place the outside corner 25*b* of the accepted flange into interferring contact with the inside of wall 17*a*. Further turning of the flange of the accepted member will cause the two resilient structural members to deform sufficiently to permit the lip 20*b* to move down the inner surface of the wall 18*a***.

Because of the geometry of the system, the biasing pressure exerted by the deformed member is greatest at the time that the lip **20*b* starts to move down the wall and becomes progressively less as the lip swings into parallel alignment with the wall 18*a* of the receiving flange. As a result of this decreasing biasing pressure, the side wall 18*b* of the accepted flange is pulled rapidly into seating contact against the base of the receiving flange as shown in FIG. 3** and the accepted flange is brought into contiguous alignment within the receiving flange.

As can be seen because of the predetermined shape of the flange, the elongated webs of the two cojoined members are supported at a right angle when the two members are brought together. It should be further noted that the lip provided to each interlocked flange also serves to hold the interlocked members in alignment as well as preventing them from becoming separated in assembly.

Referring once again to FIG. 1, there is shown a building column of rectangular form that is created through interlocking four members together. To form this column, three structural members are snapped together at their flanges as described above to establish a three sided section. The last or final member of the assembly is then simply joined to the section by sliding the two end flanges of the last member into the two unfilled flanges remaining in the section. This locks the four members securely together with sufficient holding power to permit the column to be quickly and safely erected at the building site.

While this invention has been described in reference to the disclosure herein set forth, it is not necessarily limited to this particular embodiment and this application is intended to cover any modifications or changes as may come within the scope of the present invention.

I claim:

1. A flanged structural member that is adapted to interlock with a second flanged member of similar construction to form a right angle corner section, the structural member including an elongated planar web having a rectangular, open-sided, flange depending outwardly from each longitudinal edge thereof, each flange containing parallel side walls of substantially equal depth that are positioned normal to the plane of the web, the proximal edges of the two side walls being cojoined by a flat base wall and the distal edge of the inner side wall being joined to one longitudinal edge of the web to project the flange laterally to one side of the web with the open side of the flange facing the opposite side of the web whereby the distal edge of the outer side wall of the flange is situated in the plane of the web, a lip lying in the plane of the web that depends inwardly toward the web from the distal edge of the outer side wall to restrict the opening in the flange, the outside depth of the flange as measured over the lip and the base wall being equal to or slightly less than the inside width of the flange as measured between the inside surface of the two side walls whereby the lip of a flange on one member may be inserted into the opening of a flange on a second member and the members rotated to bring the webs into perpendicular alignment wherein one flange is securely seated in wall to wall contact within the other flange.

2. The structural member of claim 1 wherein the length of the lip is about one-third of the inside width of the flange.

3. The structural member of claim 2 wherein the web and two flanges of the member are formed of a single sheet of resilient material.

* * * * *